United States Patent [19]

Smith

[11] Patent Number: 4,594,935

[45] Date of Patent: Jun. 17, 1986

[54] BREECH LOCKING SYSTEM FOR SELF LOADING FIRE ARMS

[76] Inventor: David E. Smith, 5 Park Avenue, Telscombe Cliffs, Sussex, England

[21] Appl. No.: 593,396

[22] Filed: Mar. 26, 1984

[30] Foreign Application Priority Data

Mar. 28, 1983 [GB] United Kingdom ..... 8308421

[51] Int. Cl.[4] ..... F41D 3/00; F41D 5/02

[52] U.S. Cl. ..... 89/176; 42/75 B; 89/138; 89/168; 89/199

[58] Field of Search ..... 89/168, 176, 138, 164, 89/199; 42/75 B

[56] References Cited

U.S. PATENT DOCUMENTS

| | | | |
|---|---|---|---|
| 1,311,715 | 7/1919 | Rosebush | 89/196 |
| 1,511,510 | 10/1924 | Diehm | 89/199 |
| 2,115,041 | 4/1938 | Obregon | 89/138 |
| 2,135,992 | 11/1938 | Walther et al. | 89/176 |
| 2,958,974 | 11/1960 | Sefried | 42/75 B |
| 2,975,680 | 3/1961 | Wilson | 42/75 B X |
| 3,110,223 | 11/1963 | Schlappich | 42/75 B X |
| 3,408,895 | 11/1968 | Lopez | 89/176 X |
| 3,411,405 | 11/1968 | Pachmayr et al. | 89/196 |
| 4,176,584 | 12/1979 | Thomas et al. | 89/138 |

*Primary Examiner*—David H. Brown

*Attorney, Agent, or Firm*—Harness, Dickey & Pierce

[57] ABSTRACT

In a locked-breech, short recoil, pistol type fire arm, the breech block slide (B) is provided with a separate locking block (E) engageable with both the barrel (C) and the slide (B) and accommodated between the underside of the barrel (C) and the upper surface of a movable trigger guard (D). Hold open means (X) are provided operable in the absence of cartridges in a magazine (T) or in the breech to allow the slide (B) to be held in the fully retracted position and simultaneously to release the trigger guard (D) for limited forward and downward movement, the trigger guard being provided with means which on movement of the trigger guard cause the locking block (E) to disengage from the barrel, whereby the barrel can be removed without the need for further disassembly of the fire arm.

13 Claims, 25 Drawing Figures

Fig. 7
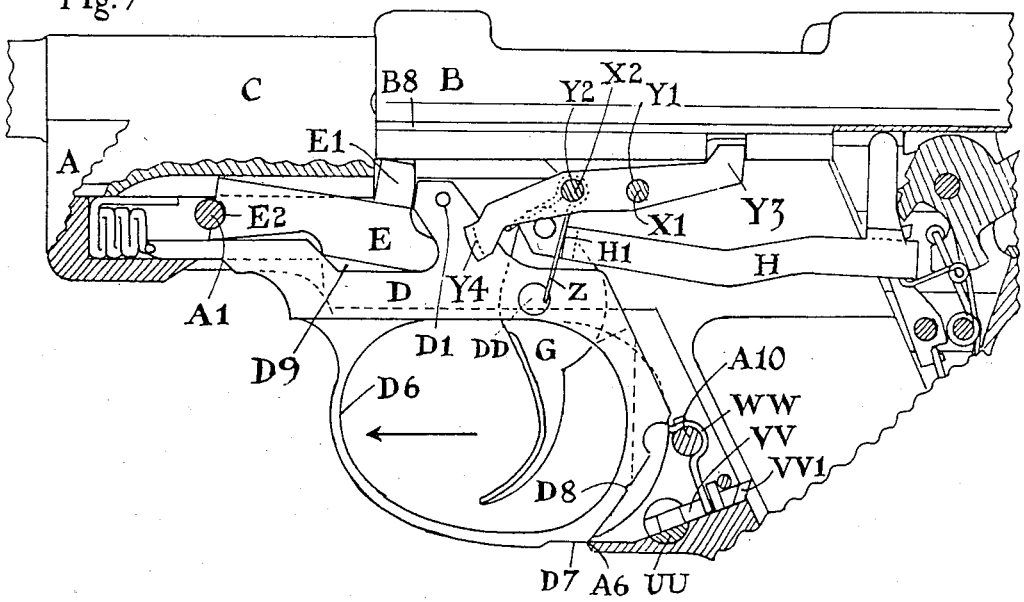
Fig. 8
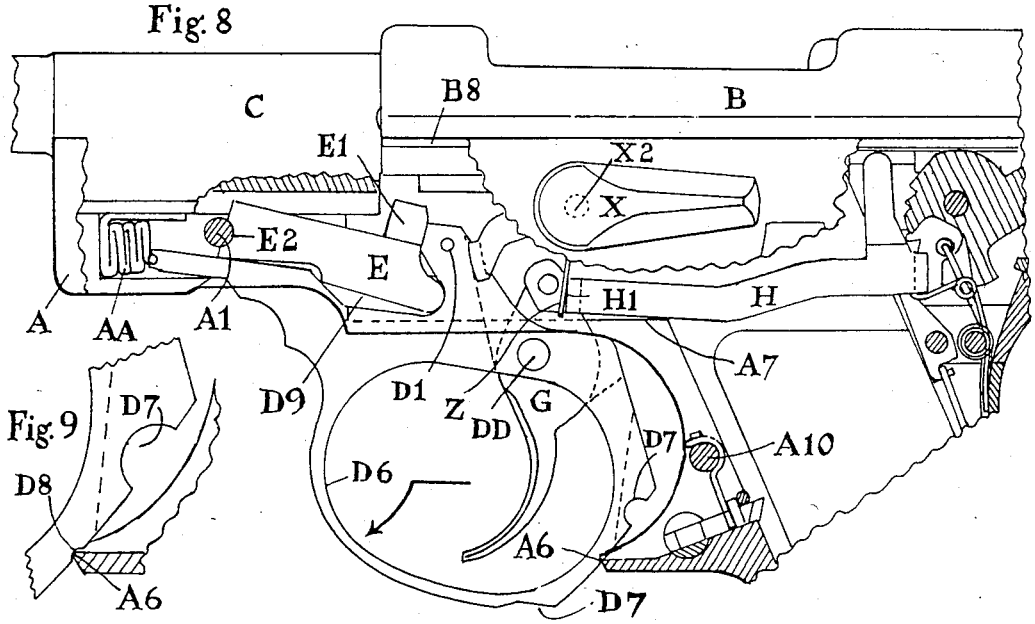
Fig. 9
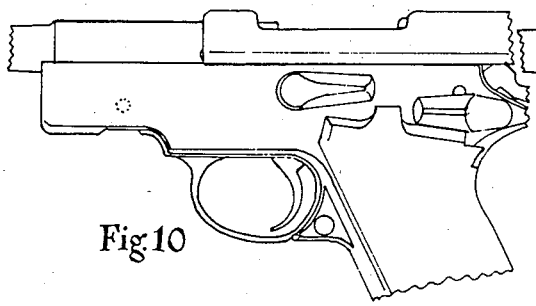
Fig. 10
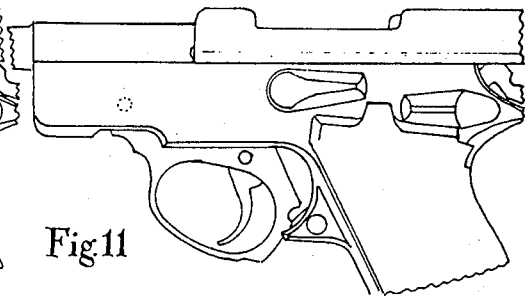
Fig. 11

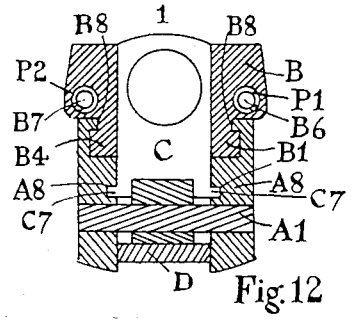
Fig. 12
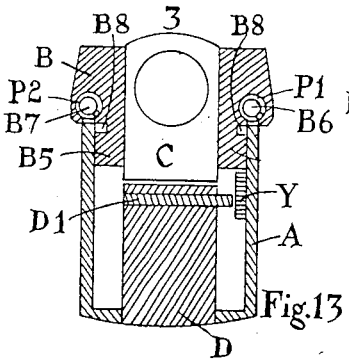
Fig. 13
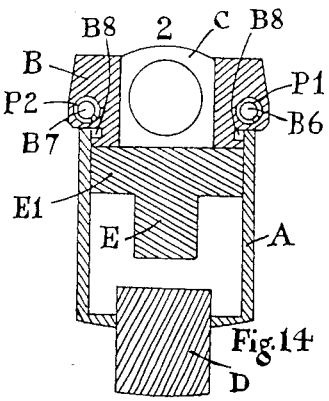
Fig. 14
Fig. 15
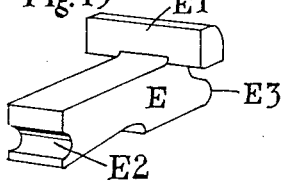
Fig. 16
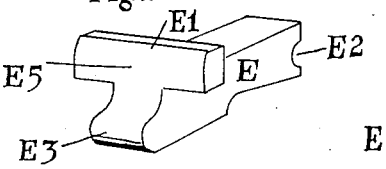
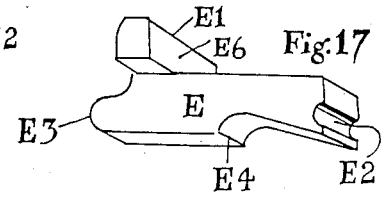
Fig. 17
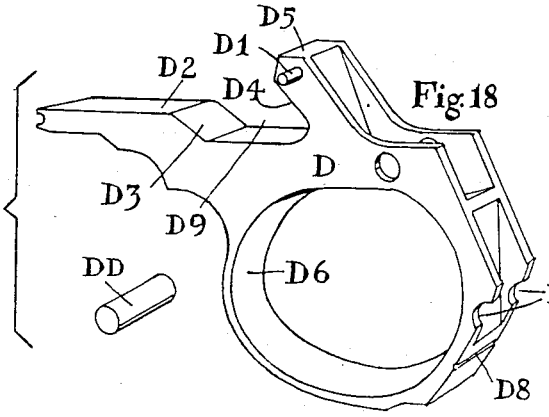
Fig. 18
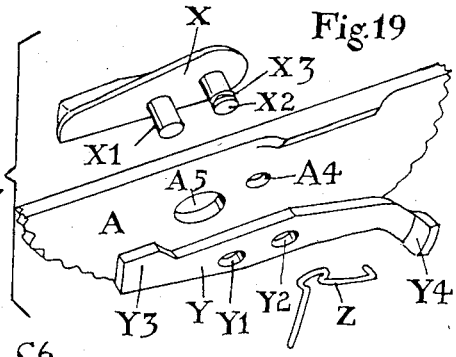
Fig. 19
Fig. 20
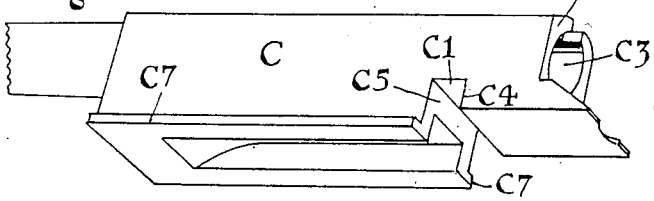
Fig. 21
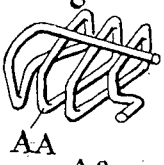
Fig. 22
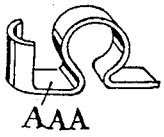
Fig. 23
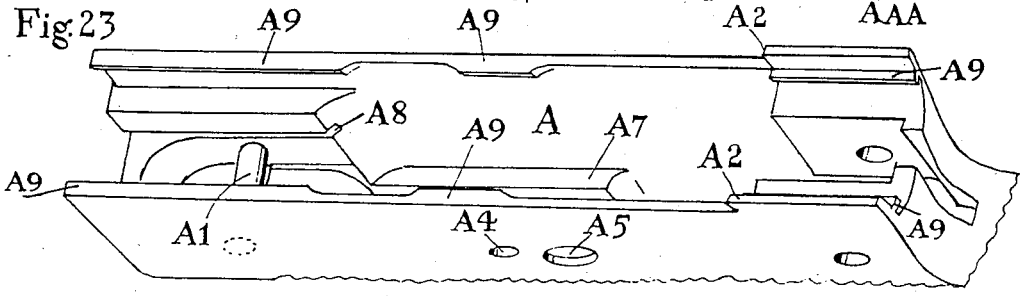

BREECH LOCKING SYSTEM FOR SELF LOADING FIRE ARMS

This invention relates to fire arms of the self loading, locked breech, short recoil, pistol type, in which a separate locking block is employed, and more particularly to fire arms of the kind having means for automatically locking the barrel and breech block together during the discharge of the cartridge in the breech, for the purpose of ensuring positive obturation of the cartridge case walls to the breech chamber until the high pressure period of the powder gases is over, and then to automatically allow the breech block slide to separate from the barrel and permit the extraction of the cartridge case safely.

The usual practice in self-loading locked breech pistols is for them to employ a barrel locking to the slide, either by studs, ribs, or other means, and rotated, cammed, or otherwise moved out of engagement with the slide after the end of the high pressure period of the cartridge powder gases, or to employ a separate block to lock barrel to slide during the aforesaid high pressure period. The usual practice in self loading locked breech fire arms is for the residual pressure in the barrel interior plus the inertia of the barrel and slide moving rearwards in reaction to the projectile's discharge to disengage whatever lock is employed, and to furnish the energy required to complete the cycle of cartridge case extraction and ejection, and the reloading of the barrel chamber with a loaded cartridge from a magazine in the fire arm.

It is usual in self-loading locked breech pistols employing any of the breech locking systems previously mentioned to provide means for the removal of the barrel from the pistol. The usual practice is for a catch to be provided which, by manipulation or removal, allows the barrel and slide, together with, in most types of pistol, the recoil spring assembly, to be removed from the pistol main frame. Usually, the barrel can then be removed from within a recess in the slide. The disadvantage of this practice in pistols is that in order to remove the barrel for any reason, additional parts of the pistol must be removed from the main frame, and it is inconvenient to find accommodation for such parts which are liable to be exposed to dirt, be misplaced or be damaged. In the Walther P38 and Beretta models 951 and 92, the locking block is accommodated in a recess under the rear of the barrel. Although the Walther locking block is easily detached from the barrel it is possible to reassemble the pistol with the block absent, resulting in a very dangerous situation should the pistol then be fired with a normal ball cartridge. The Beretta pistols require tools to detach the locking block. Greater convenience is provided by certain pistols using low pressure cartridges and not requiring a locked breech, that allow the barrel alone to be removed initially, with the rest of the pistol intact.

It is, therefore, an object of the present invention to provide for self loading pistols using high pressure cartridges, a system that provides a positive lock between barrel and breech block or slide during the high pressure period of the firing cycle, and that allows the normal operation of such a pistol or fire arm, while also providing that the barrel alone can be removed from the fire arm when required.

It is another object of the invention to simplify the manipulations involved in disassembling and assembling a self loading pistol or other fire arm.

It is another object of the invention to provide a locking block for a self loading pistol or other fire arm that is easily removed but is an essential part of the pistol or other fire arm, and cannot be left out on assembly.

It is another object of the invention to provide a breech locking system for a self loading pistol or other fire arm that does not require tools to assemble and disassemble.

It is a subsidiary object of the invention to provide means of indication to indicate to the user when the inserted cartridge magazine is empty.

Finally, it is an object to provide a breech locking system for a self loading pistol or other fire arm which is of simple construction and cheap to manufacture.

According to the invention, there is provided a self loading fire arm of the locked breech, short recoil pistol type having a barrel and a breech block slide provided with a separate locking block accommodated between the underside of said barrel and the upper surface of a movable trigger guard, said locking block having means for positively locking the barrel to the slide during the high pressure period of the firing cycle of the fire arm and means for releasing the slide from the barrel during the remainder of the firing cycle, said trigger guard being normally locked to the frame, and hold open means operable in the absence of cartridges in a magazine and in the breech to allow said slide to be held in the fully retracted position and simultaneously to release said trigger guard for limited forward and downward movement, said trigger guard being provided with means which on said movement cause said locking block to disengage from the barrel, whereby the barrel can be removed without the necessity for further disassembly of the fire arm.

An embodiment of the invention is shown in the drawings and will be described in greater detail hereinafter.

FIG. 1 of the accompanying drawings represents, partly in elevation and partly in longitudinal vertical section, a self loading semi-automatic pistol provided with means constructed and arranged in accordance with this invention for locking and unlocking the slide and barrel together during the firing cycles of the pistol, and means to allow the pistol to be disassembled, showing the pistol in battery position, cartridge in chamber, locking block forward, slide locked to barrel by locking block;

FIG. 7 is a part elevation, part longitudinal vertical section of the upper part of the pistol, showing part of the operation to disassemble barrel from pistol;

FIG. 8 is a similar view to FIG. 7 showing a further part of the operation to disassemble barrel from pistol;

FIG. 9 shows on an enlarged scale and partly in section and partly in elevation details from FIG. 8 of the trigger guard and frame;

FIG. 10 shows on a reduced scale a part elevation of the pistol with slide locked to rear;

FIG. 11 shows on a reduced scale a part elevation of the pistol with trigger guard in the position as in FIG. 8;

FIG. 12 is a transverse vertical section of FIG. 1 along line 1;

FIG. 13 is a transverse vertical section of FIG. 1 along line 3;

FIG. 14 is a transverse vertical section of FIG. 1 along line 2;

FIG. 15 is a perspective view of the locking block;

FIG. 16 is another perspective view of the locking block;

FIG. 17 is yet another perspective view of the locking block;

FIG. 18 is a perspective view of the trigger guard with trigger axis pin;

FIG. 19 is a perspective view of the slide hold open assembly;

FIG. 20 is a perspective view of the barrel;

FIG. 21 is a perspective view of a trigger guard spring;

FIG. 22 is a perspective view of an alternative trigger guard spring;

FIG. 23 is a perspective view of the upper frame;

The same letters of reference indicate corresponding parts in several figures of the drawings.

Figures 1, 2:
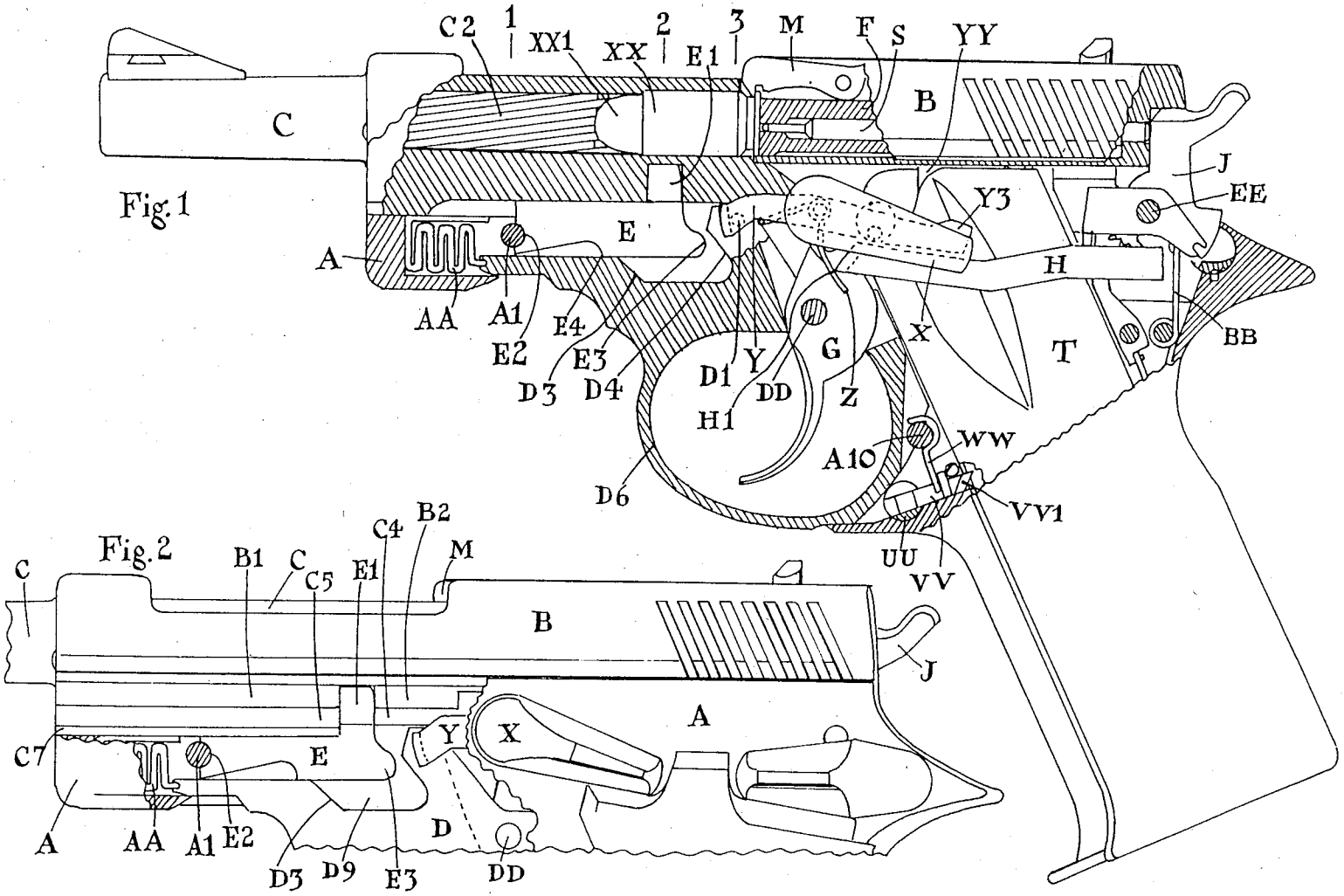
FIG. 2 is a part elevation, part longitudinal vertical section of the upper part of the pistol in battery position.

In the self loading pistol represented in FIG. 1, the barrel C and slide B are mounted on the frame A. The locking block E which rides on the surface D2 of trigger guard D, is engaged by means of wing E1 into recess C1 in barrel C and recess B3 between slide recoil rails B1 and B4 and B2 and B5. The slide B and barrel C being held together by locking block wing E1 are thrust forward by recoil springs P1 and P2 compressed by rear guides R1 and R2 (not shown) acting upon frame wings A2 and A3, and retained in the slide by forward recoil guides Q1 and Q2 (not shown) by recoil springs retainer RR. The slide and barrel and locking block together are thrust forward as a whole and thereby the groove E2 in the front locking block surface impinges on frame pin A1 which is permanently held in the frame, the frame pin A1 thereby restricting the forward motion of the whole slide, barrel and locking block combination. When the cartridge XX is fired by the firing pin S, which is thrown forward by hammer J being rotated on axis pin EE by main spring BB, pressure is exerted equally on bullet XX1 and through breech insert F to the slide.

Figure 3:
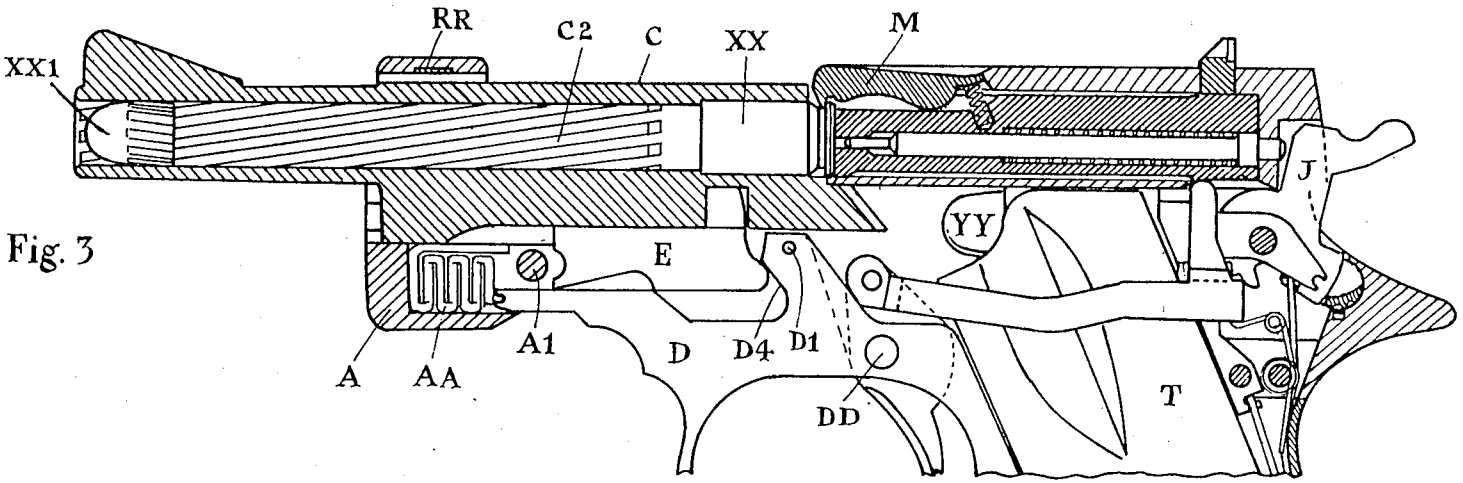
FIG. 3 is a part elevation, part longitudinal vertical section of the upper part of the pistol during a period of the firing cycle.
Figure 4:
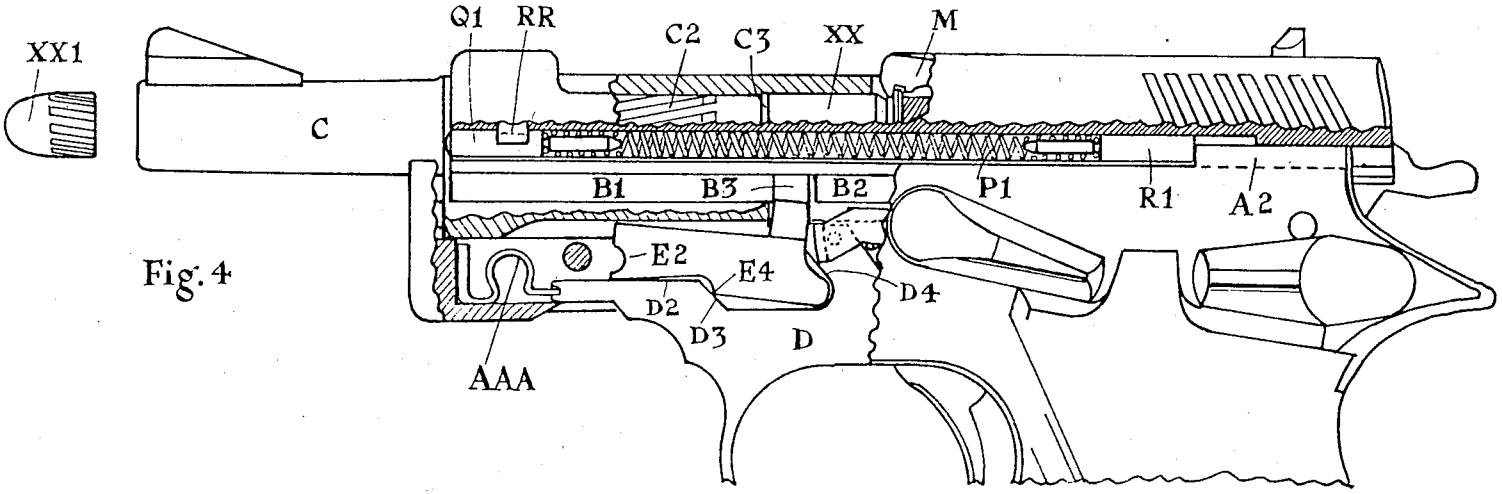
FIG. 4 is a part elevation, part longitudinal vertical section of the upper part of the pistol during a further period of the firing cycle.
Figure 5:
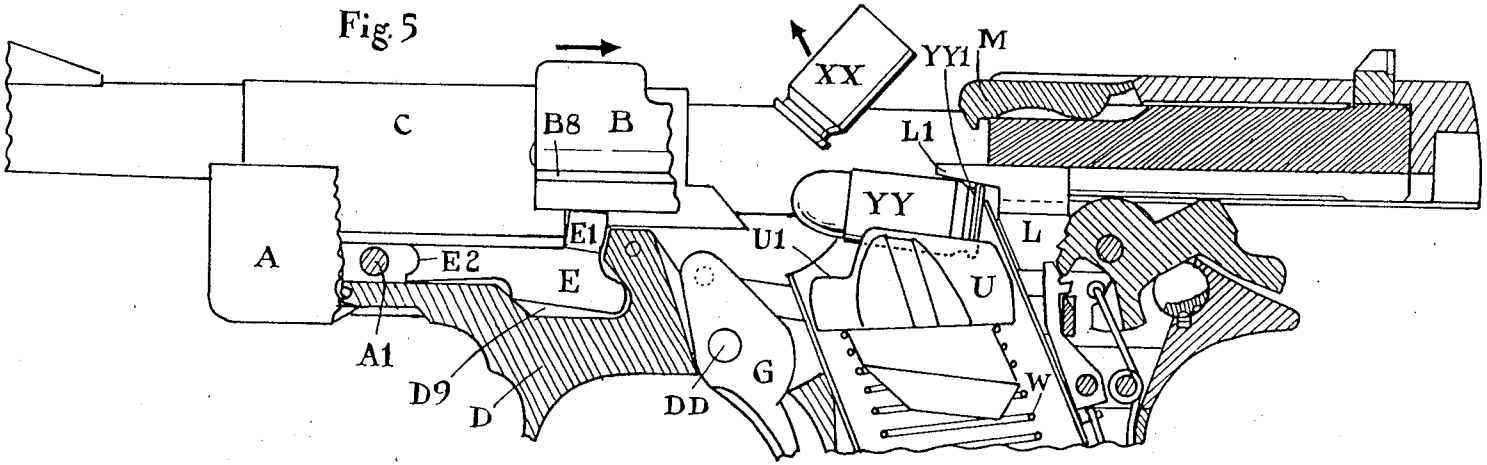
FIG. 5 is a part elevation, part longitudinal vertical section of the upper part of the pistol during a further period of the firing cycle.

During this period of high cartridge gas pressure while the bullet travels along barrel bore C2 as shown in FIG. 3 the slide and barrel recoil to the rear, locked together by the locking block wing, until locking block surface E3 impinges on trigger guard cam surface D4. The locking block is forced by the continuing rearward motion of the slide, as shown in FIG. 4, to be cammed downwards by surface D4 until the locking block wing extensions disengage from the rear surface of the slide recoil rails and thereby allow the slide to freely continue to the rear as shown in FIG. 4. The locking block wing is still engaged in barrel recess C1, and as the upper surface of the locking block wing bears against the underneath surface of the slide recoil rails B1 and B4, and cannot move forward by locking block point E4 bearing on trigger guard cam D3, the barrel is held stationary by surfaces C4 and C5 being engaged by the locking block wing. During the camming of the locking block by surface D4, the cartridge case is subjected to primary extraction, being withdrawn from barrel chamber C3 by extractor M. The bullet has left the barrel and residual pressure in the barrel and inertia will continue the rearward motion of the slide to the position as shown in FIG. 5. During the rearward motion of the slide the cartridge case is extracted completely from the barrel chamber C3 and striking the nose L1 of ejector L the cartridge case is ejected from the pistol.

Acting under pressure of the recoil springs the slide will then move forward striking the base of cartridge YY in magazine T and feed the cartridge into the barrel chamber. The extractor will engage with the cartridge canelure YY1 while the cartridge is being chambered. During the forward motion of the slide the position as shown in FIG. 4 is attained. The cartridge is almost fully chambered when the slide recoil rail recesses align with the barrel recess thereby allowing the locking block wing free passage to rise.

Figure 25:
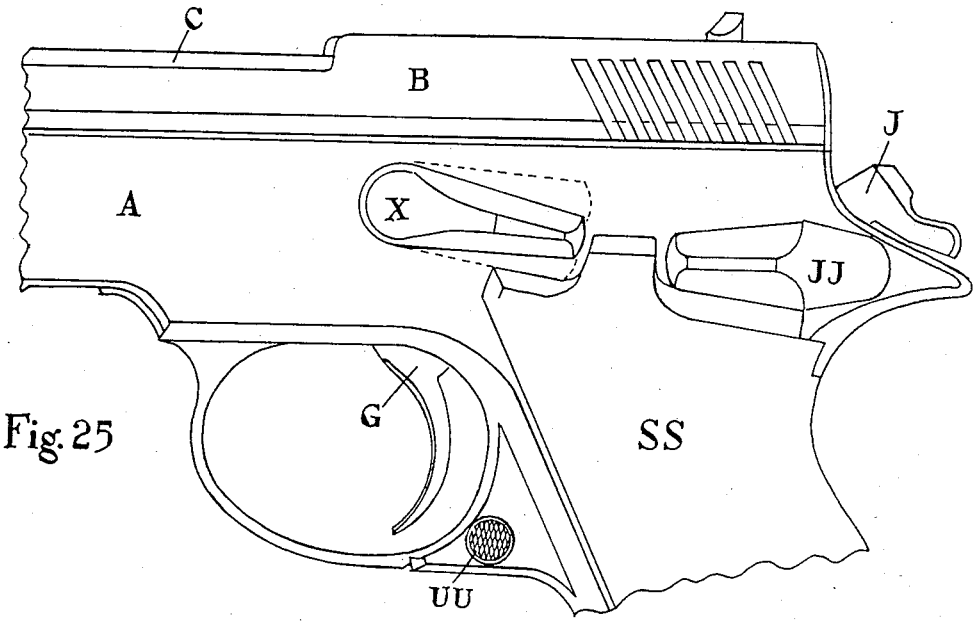
FIG. 25 is a partial left side elevation of the pistol with the chamber loaded, hammer cocked, and the hold open catch in the midway position, indicating an empty magazine is held in the pistol. The dotted lines show the upper and lower limits of the hold open catch.

The slide continues forward and the forward inner face of the slide B9 abuts the rear face of the barrel C6 thereby forcing the barrel also to move forward and barrel surface C4 abutting the rear face of the locking block wing E5 forces locking block point E4 to be cammed up the trigger guard surface D3, thereby lifting the locking block wing into full engagement in both slide recoil rail recesses and the barrel recess. Further pressure by the recoil springs forces slide and barrel and locking block, locked together by the locking block wing, forward until the whole are arrested by locking block surface E2 impinging on frame pin A1. When the last cartridge has been fed from the magazine into the chamber of the barrel the magazine follower will rise until its upper surface U2 impinges on the under surface of the slide. At this point the shelf U1 will have lifted the hold open unit (X, Y) to a point approximately midway between its lower rest position and the raised position it assumes when, as shown in FIG. 7, the hold open is locking the slide in the rear position. This midway position can be seen as in FIG. 25, and felt, and acts as an indicator that the magazine is empty and, at any point in time, at night, with the pistol or fire arm in the aimed position, or any other situation, the user has the knowledge that one cartridge remains in the chamber and that the magazine is empty. Thus the pistol or fire arm can be reloaded without at any time being rendered totally inoperable. This assumes no magazine safety is fitted to the gun; such a device would have to be removed to render the magazine indicator capable of serving its full purpose. In the pistol described no magazine safety is fitted. The magazine indicator would also operate should the chamber and magazine be empty. FIG. 25 shows the empty magazine indicated position of the hold open catch, the dotted lines showing the upper and lower limit positions of the catch. The hold open unit consisting of an external member X having a pivot pin X2 and a rear pin X1, and an inner member Y having holes Y2 and Y1 to receive the pins X2 and X1, these pins passing through holes A4 and A5 in the frame, the hole A5 being sufficiently large to allow the pin X1 to move in it.

Figure 6:
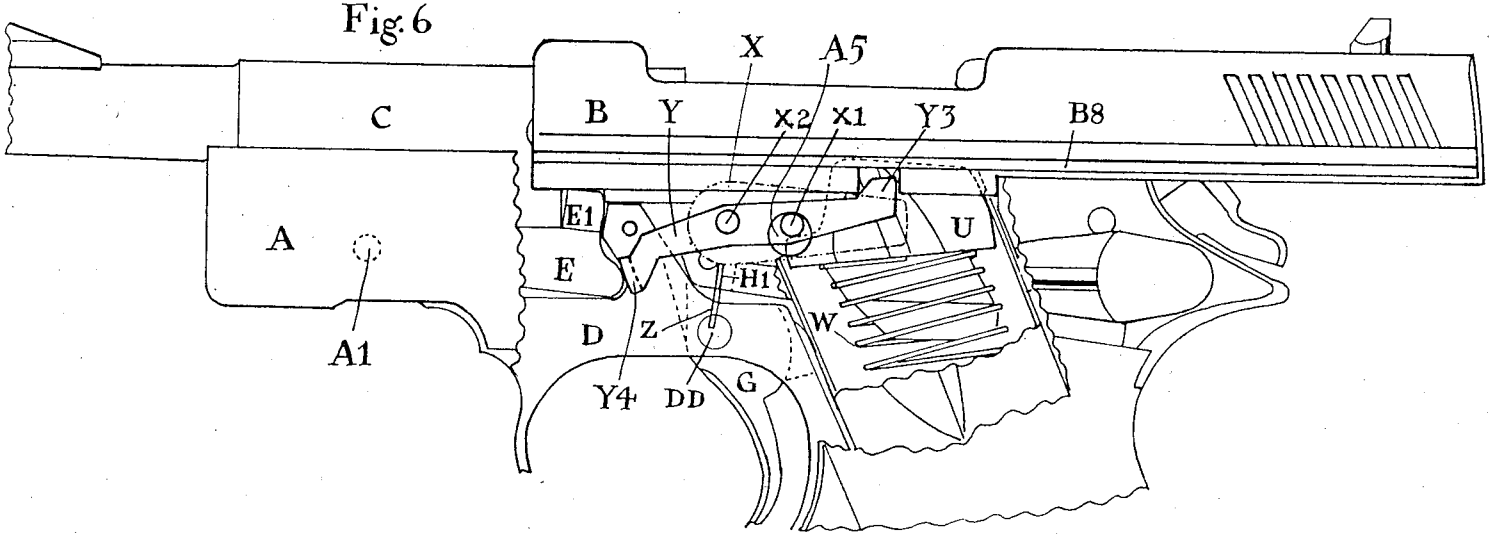
FIG. 6 is a part elevation, part longitudinal vertical section of the upper part of the pistol, with the slide in the rear locked position.
Figure 24:
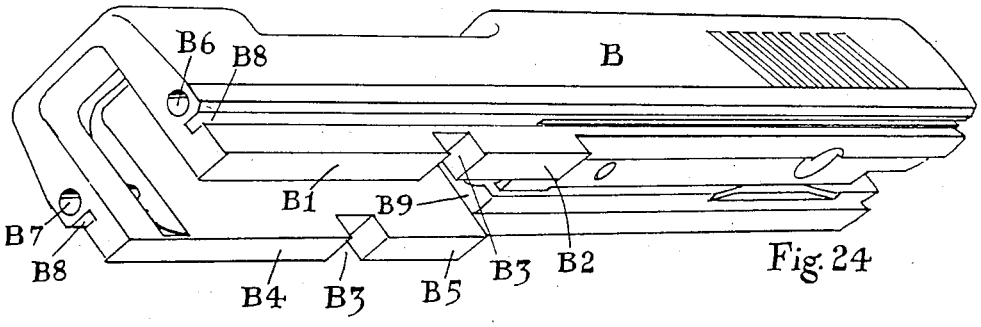
FIG. 24 is a perspective view of the slide.

Upon the discharge of the last cartridge in the barrel chamber the slide will recoil and the magazine follower will rise fully when the slide base moves clear of the follower, and thereby the magazine follower shelf U1 will raise the hold open fully, in this position as shown in FIG. 6, the shelf has impinged on the hold open rear pin X1, which moves within frame aperture A5, and forces the hold open and to rotate on its axis pin X2, which pivots in frame aperture A4 and since the hold open pins X1 and X2 pass through hold open inner holes Y1 and Y2 respectively, the whole hold open unit is made to pivot, compressing hold open spring Z against the forward part H1 of the trigger bar H. As the whole hold open unit rotates the inner rear end Y3 of the inner member rises and locates in slide recoil rail recess B3 when the slide reaches the full rearward position under recoil or when manually retracted. It will be observed that the forward end Y4 of the hold open inner member depresses as the rear Y3 elevates, and the forward end moves to clear the front of stud D1 which is permanently fixed transversely in the trigger guard cam lug D5. It is only in this position that the trigger guard can be moved forward against the resistance of the trigger guard spring, thus during all firing operations of the pistol, the trigger guard cannot move forward.

To remove the barrel from the pistol the slide is locked to the rear by the hold open unit as previously described and the magazine is removed by depressing from the left or right side of the pistol the magazine catch plunger UU which will retract the nose VV1 of the magazine catch VV which is forced to the rear by spring WW. The forward inner surface D6 of the trigger guard is pushed forward, as shown by the arrow in FIG. 7, and thereby the locking block which is seated in the trigger guard recess D9 will be forced forward and impinge on the frame pin A1. The trigger guard surface D7 will move clear of frame point A6 and the trigger guard can be moved downwards, the trigger guard and locking block will then be rotating on the frame pin A1. The rotation of the trigger guard will be arrested by the trigger bar contacting frame surface A7 and frame ledge A6 will seat in trigger guard detent groove D8. The locking block, when in its lowered position within the trigger guard, will completely disengage the locking block wing from barrel recess C1 leaving the barrel free to move forward on the runners C7 sliding in the frame guides A8 each side, with reference to FIGS. 12 and 20 and 23. The barrel will slide clear of the frame and when the hold open unit is disengaged from the slide, the slide can be slid forward off the frame. To remove the locking block the trigger guard is returned to the position as shown in FIG. 10 and with the barrel and slide detached from the frame the locking block can be removed upwards from the frame. To reassemble the slide and barrel to make the pistol operational the trigger guard with the locking block is put in the position as shown in FIG. 8. The slide is mounted on the frame with the slide guides B8 engaged with frame runners A9 and held in the rear position with the hold open catch. The barrel is then mounted in the frame with the barrel runners in the frame guides and slid to the rear until barrel face C5 abuts with the forward face E6 of the locking block. The trigger guard is then pivoted upwards which engages the locking block wing to the position as FIG. 7, and the trigger guard spring will then force the trigger guard and locking block and barrel rearwards to the position in FIG. 6, the rearward motion of the trigger guard, and thus the whole, being arrested by frame pin A10 which is permanently mounted transversely in the frame.

If no magazine is in the pistol, the hold open unit can be operated manually by rotation of the outer member X to hold the manually retracted slide in position.

When the trigger guard is in the FIG. 8 position the trigger axis pin DD can be extracted from either side of the trigger guard to permit the trigger G and trigger bar H to be removed from the pistol.

The application of the invention to other small arms differs in no essential respect from its application to pistols of the type hereinbefore described.

The terms "horizontal" and "vertical" as used herein refer to the pistol or other fire arm when held in the normal firing position.

I claim:

1. A self loading fire arm of the locked breech, short recoil pistol type having a barrel and a breech block slide provided with a separate locking block accommodated between the underside of said barrel and the upper surface of a movable trigger guard, said locking block having means for positively locking the barrel to the slide during the high pressure period of the firing cycle of the fire arm and means for releasing the slide from the barrel during the remainder of the firing cycle, said trigger guard being normally locked to the frame, and hold open means operable in the absence of cartridges in a magazine and in the breech to allow said slide to be held in the fully retracted position and simultaneously to release said trigger guard for limited forward and downward movement, said trigger guard being provided with means which on said movement cause said locking block to disengage from the barrel, whereby the barrel can be removed without the necessity for further disassembling of the fire arm.

2. A fire arm as claimed in claim 1, including a pin fixed in the frame and serving as a stop against rearward movement of said trigger guard.

3. A fire arm as claimed in claim 1, wherein the forward and downward movement allows the removal of a trigger pivot pin to permit removal of the trigger and trigger bar.

4. A fire arm as claimed in claim 1, wherein a nose is provided on the frame and a detent is provided on the trigger guard, the nose engaging the detent when the trigger guard is in its lowermost position.

5. A fire arm as claimed in claim 1, wherein forward movement of said locking block is arrested by infringement of the front of said block on a fixed part of the frame.

6. A fire arm as claimed in claim 5, wherein said fixed part is a round pin and the front of said block has a part-circular groove therein which cooperates with said pin to permit pivotal movement of the block about the pin.

7. A fire arm as claimed in claim 1, wherein said means for positively locking the barrel to the slide comprise an upstanding transverse wing provided on said block, said wing having outer portions adapted to engage in recesses in the bottom of the side walls of the slide, and a central part adapted to engage in a recess in the bottom of said barrel, whereby said barrel and slide can be positively locked together and to said block.

8. A fire arm as claimed in claim 7, wherein said trigger guard is provided with a cam surface, which co-operates with said locking block to disengage said wing from the recesses in said slide at the end of the high pressure period of the firing cycle.

9. A fire arm as claimed in claim 7, wherein said hold open means comprises an inner member which is pivotable intermediate its ends in said frame, one end of said inner member being engageable in said recess in the bottom of one side wall of the slide and the other serving as a safety catch against forward motion of said trigger guard, the pivoting motion of said inner member being such that upward movement of said one end into engagement with said recess is accompanied by downward movement of the other end to release said trigger guard.

10. A fire arm as claimed in claim 9, wherein in the locking position, said other end of said inner member abuts against a stud formed thereon to prevent forward movement of the trigger guard.

11. A fire arm as claimed in claim 9, wherein said hold open means is provided with spring means acting against the pivotal movement into the slide holding position, said spring also acting as a return bar for the trigger bar of the firing lock of the fire arm.

12. A fire arm as claimed in claim 9, wherein the magazine follower is moveable responsive to the magazine being empty and the last cartridge in the breech chamber having been fired to engage and cause pivotal movement of said hold open means to a position to hold said slide in the fully retracted position and to free the trigger guard.

13. A fire arm as claimed in claim 12, wherein said hold open means includes an outer member pivoting with said inner member and said magazine follower is movable responsive to emptying of the magazine to engage and pivot said hold open means to an intermediate position whereby the position of said outer member affords a visual and tactile indication that the magazine is empty but the chamber contains a cartridge.

* * * * *